US007971815B2

(12) United States Patent
Schulte et al.

(10) Patent No.: US 7,971,815 B2
(45) Date of Patent: Jul. 5, 2011

(54) MILLING STATION AND METHOD FOR GRINDING MILLING MATERIAL

(75) Inventors: Ludger Schulte, Ahlen (DE); Franz-Josef Zurhove, Bad Iburg (DE); Donald A. Longhurst, Kennesaw, GA (US)

(73) Assignee: Polysius AG, Beckum (DE)

( * ) Notice: Subject to any disclaimer, the term of this patent is extended or adjusted under 35 U.S.C. 154(b) by 749 days.

(21) Appl. No.: 11/816,247

(22) PCT Filed: Feb. 14, 2006

(86) PCT No.: PCT/EP2006/001339

§ 371 (c)(1),
(2), (4) Date: Apr. 16, 2008

(87) PCT Pub. No.: WO2006/087167

PCT Pub. Date: Aug. 24, 2006

(65) Prior Publication Data

US 2009/0020636 A1 Jan. 22, 2009

(30) Foreign Application Priority Data

Feb. 16, 2005 (DE) ..... 10 2005 007 254

(51) Int. Cl.
*B02C 21/00* (2006.01)

(52) U.S. Cl. ..... 241/80; 241/152.2

(58) Field of Classification Search ..... 241/80, 241/152.2, 76–79, 97, 170
See application file for complete search history.

(56) References Cited

U.S. PATENT DOCUMENTS 5,529,248 A * 6/1996 Sawamura et al. ..... 241/19
5,551,639 A * 9/1996 Artemjev et al. ..... 241/5
5,897,063 A * 4/1999 Patzelt et al. ..... 241/24.1

FOREIGN PATENT DOCUMENTS

DE 40 23 264 3/1991
DE 195 14 971 11/1995

* cited by examiner

*Primary Examiner* — Faye Francis
(74) *Attorney, Agent, or Firm* — Gifford, Krass, Sprinkle, Anderson & Citkowski, P.C.

(57) ABSTRACT

A milling station and a method for grinding milling material using at least one coarse grinding circuit and at least one fine grinding circuit. The coarse grinding circuit includes a classifier and a material bed roller mill. The fine grinding circuit includes a tube mill with at least two grinding chambers, a central outlet, and a divider. In some instances, at least some of the milling material from the coarse grinding circuit is subdivided in the divider and delivered to the at least two grinding chambers of the fine grinding circuit while some of the milling material is jointly discharged from the at least two grinding chambers through the central outlet.

7 Claims, 3 Drawing Sheets

MILLING STATION AND METHOD FOR GRINDING MILLING MATERIAL

Figure 1:
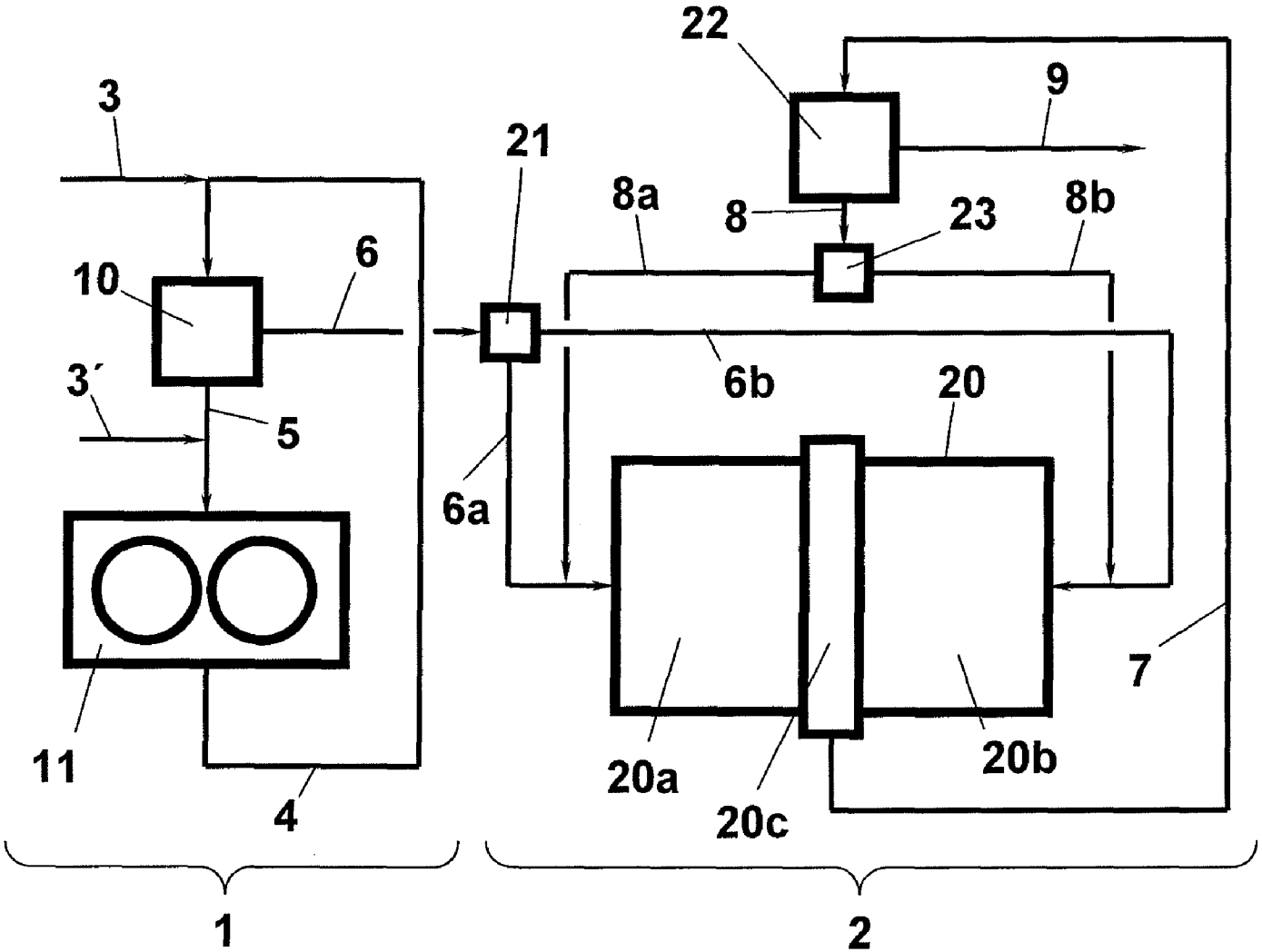

The invention relates to a grinding station as well as a method for grinding grinding material with at least one coarse grinding circuit and at least one fine grinding circuit.

It is sufficiently known, in connection with the grinding of cement clinker, to carry out the coarse grinding by means of a so-called material bed roller mill in order to subsequently grind the precrushed product to the final fineness in a tube or ball mill. These methods are called combination or partial finish-grinding. In most cases the two grinding circuits comprise a classifier, so that the grinding material is repeatedly recirculated in part in the individual grinding circuits.

The throughput capacity of grinding stations of this kind is usually limited by the tube mill. However technical boundary conditions must be taken into account in the design of the tube mills. Thus the cross-sectional load on the ball bed should not exceed 90 t/($m^2$h). If the load were higher, the grinding material would run away because of the drag of the balls. The load-bearing capacity would be even lower in the case of relatively high fineness values, as the throughput is volumetric and the packing density decreases.

Moreover, a circulating load of the sorter of at least 1.8 to 2.0 is desirable in order to obtain sufficiently low residue values in the finished material. On the other hand, the mill diameter cannot be increased arbitrarily, as the number of layers of balls in finely calibrated combination mills becomes too high. There is thus a slip between each layer, so that there is hardly any relative movement of the balls in the inner core of the ball bed. Therefore no grinding takes place in this area.

According to DE-C-40 23 624, the ball mill is used for effective disagglomeration of the material of a material bed roller mill.

The object of the invention is to indicate a grinding station which is distinguished by very high throughput capacities. This object is solved according to the invention by the features of Claim 1.

Further configurations of the invention constitute the subject matter of the subclaims.

The grinding station according to the invention consists essentially of a coarse grinding circuit and at least one fine grinding circuit, the coarse grinding circuit comprising a classifier and a material bed roller mill and the precrushed material of the material bed roller mill entering the classifier, the coarse material of which is redelivered to the material bed roller mill and the fine material of which is delivered to the fine grinding circuit. The fine grinding circuit comprises a tube mill with at least two grinding chambers and a central outlet and a divider, at least some of the grinding material of the coarse grinding circuit being divided in the divider and delivered to the two grinding chambers and the grinding material being discharged from the two grinding chambers together via the central outlet.

According to one preferred embodiment, a classifier is also provided in the fine grinding circuit, the material coming from the coarse grinding circuit and/or the material discharged from the tube mill being delivered to the classifier, with the coarse grinding material reaching the divider and the fine material being removed.

In a further configuration of the invention grinding balls with a diameter of ≦25 mm are provided in the grinding chambers of the tube mill. Balls of this order of magnitude are more efficient than larger balls. However the use of these balls is only made possible by the sorting process in the coarse grinding circuit.

In the method according to the invention for grinding grinding material in at least one coarse grinding circuit and at least one fine grinding circuit the coarse grinding circuit comprises a classifier and a material bed roller mill, the precrushed material of the material bed roller mill entering the classifier, the coarse material of which is redelivered to the material bed roller mill and the fine material of which is delivered to the fine grinding circuit. A tube mill with at least two grinding chambers and a central outlet and a divider are also used for the fine grinding circuit, at least some of the grinding material of the coarse grinding circuit being divided in the divider and delivered to the two grinding chambers and the grinding material being discharged from the two grinding chambers together via the central outlet.

Further advantages of the invention are illustrated in detail in the following on the basis of the description of several embodiments and the drawings.

In the drawings

Figure 2:
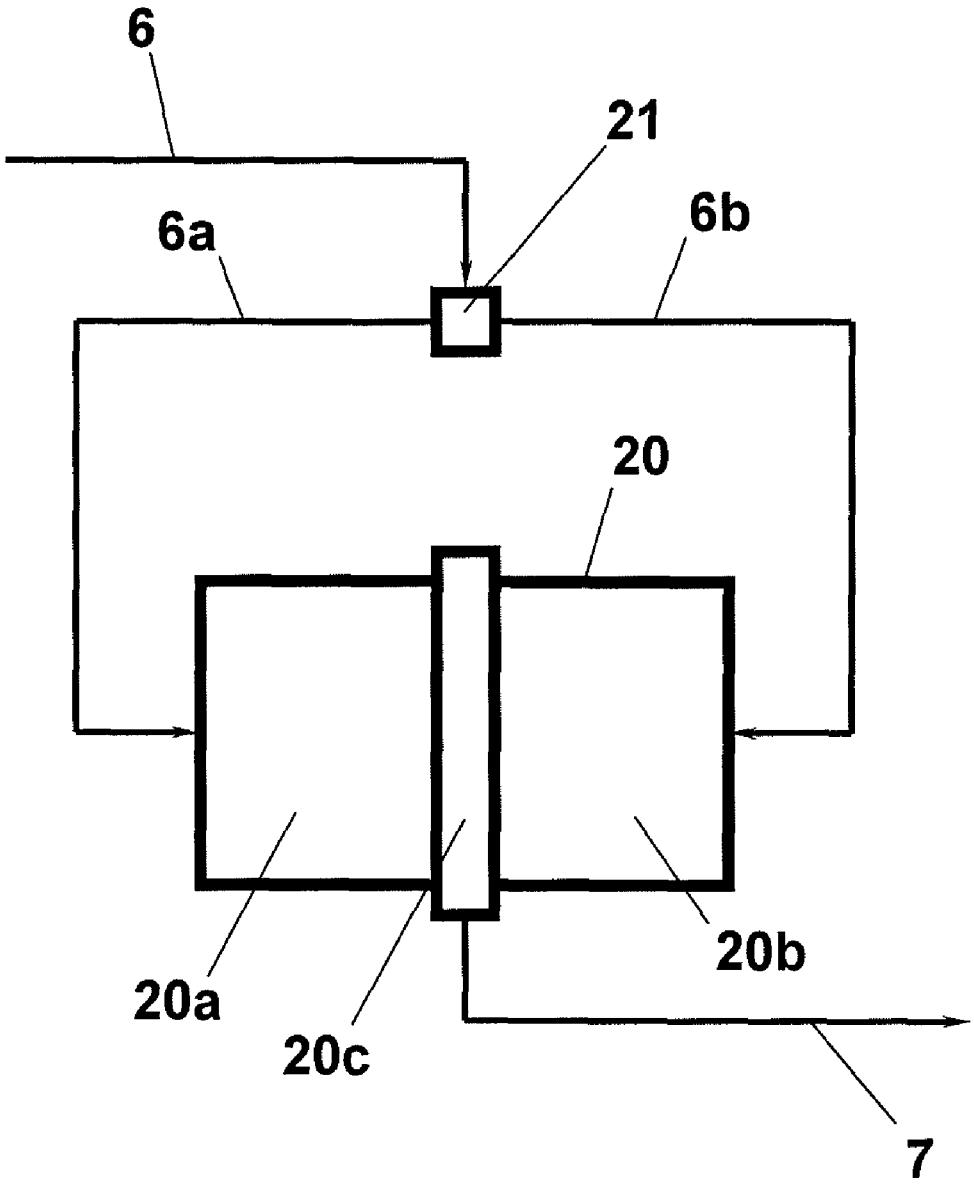
Figure 3:
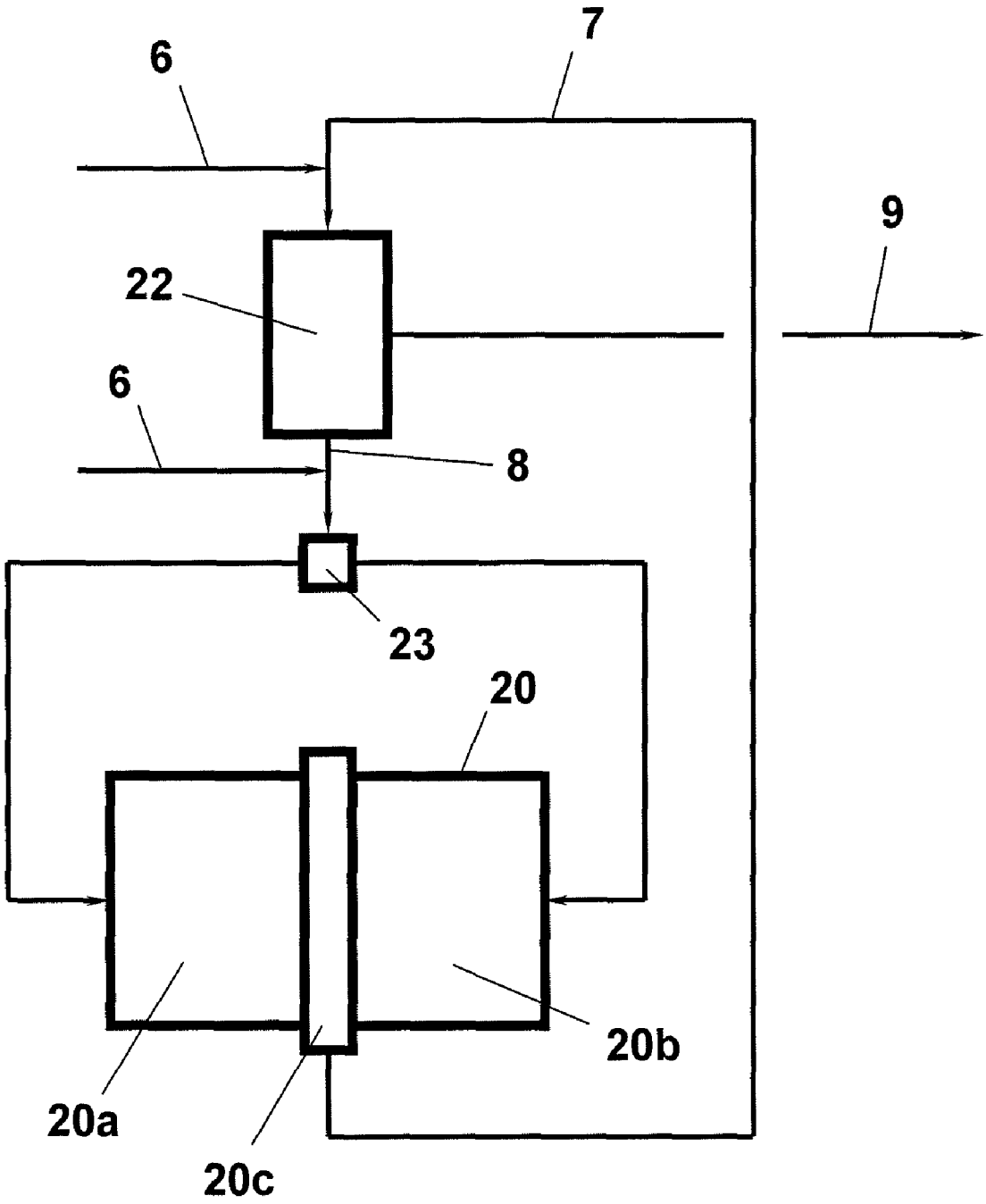

FIG. 1 is a schematic representation of the grinding station with a coarse grinding circuit and a fine grinding circuit according to a first embodiment FIG. 2 is a schematic representation of the fine grinding circuit according to a second embodiment and FIG. 3 is a schematic representation of the fine grinding circuit according to a third embodiment.

The grinding station which is represented in FIG. 1 consists essentially of a coarse grinding circuit 1 and a fine grinding circuit 2. The coarse grinding circuit 1 comprises a classifier 10 and a material bed roller mill 11. Fresh material 3 and 3', respectively, is delivered either via the classifier 10 or directly to the material bed roller mill 11. The precrushed material 4 enters, optionally together with fresh material 3, the classifier 10, the coarse material 5 of which is redelivered to the material bed roller mill 11. The fine material 6 of the classifier 10 enters the fine grinding circuit 2.

The fine grinding circuit 2 comprises a tube mill 20 with two grinding chambers 20*a*, 20*b* and a central outlet 20*c* as well as a divider 21. A classifier 22 as well as a further divider 23 are also provided.

The product flow 6 coming from the coarse grinding circuit is divided in the divider 21 into two equal partial flows 6*a*, 6*b* which are delivered to the two grinding chambers 20*a*, 20*b*. The grinding material 7 discharged from the tube mill 20 is classified in the classifier 22 into coarse material 8 and fine material 9. Whereas the fine material 9 is removed, the coarse material 8 of the classifier 22 enters the further divider 23, which divides the coarse material into two partial flows 8*a*, 8*b* which are of the same size and are delivered with the partial flows 6*a* and 6*b* of the splitter 21 to the grinding chambers 20*a* and 20*b*, respectively.

According to one preferred configuration of the invention, the two grinding chambers 20*a* and 20*b* are of identical formation, so that the dividers 21 and 23 are also set such that the grinding material 6, 8 which is delivered to the dividers is delivered to the two grinding chambers in equal portions.

The embodiment of the fine grinding circuit which is shown in FIG. 2 does not include the classifier in the fine grinding circuit, so that only the grinding material 6 of the coarse grinding circuit which is divided in the divider 21 into equal portions is delivered to the two grinding chambers 20*a*, 20*b*. The material discharged from the tube mill 20 via the central outlet 20*c* of the latter is removed as finished product 7.

FIG. 3 shows a variant of the fine grinding circuit which does not include the divider 21 according to FIG. 1. In this variant the grinding material 6 coming from the coarse grinding circuit is delivered either together with the grinding material 7 discharged from the tube mill to the classifier 22 and/or together with the coarse material 8 of the classifier to the divider 23. The divider 23 can again be set such that is produces two partial quantities of the same size which are delivered to the two grinding chambers 20*a*, 20*b* of the tube mill.

The grinding chambers of the tube mill 20 are provided with grinding balls which have a diameter of ≦25 mm. Moreover, the ratio of length to diameter of each individual grinding chamber 20*a*, 20*b* is preferably less than 2.2. It has become apparent, in tests on which the invention is based, that a ratio of length to diameter of ≦2.0 or even ≦1.7 is particularly efficient.

The tube mill 20 which has been described above enables a high throughput capacity to be achieved and can be operated at considerably less expense and in a far more energy-saving manner than two separate mills.

The invention claimed is:

1. Grinding station with at least one coarse grinding circuit (1) and at least one fine grinding circuit (2), wherein the coarse grinding circuit comprises a classifier (10) and a material bed roller mill (11) and the precrushed material of the material bed roller mill enters the classifier, the coarse material (5) of which is redelivered to the material bed roller mill and the fine material of which is at least for the most part delivered to the fine grinding circuit, wherein the fine grinding circuit comprises a tube mill (20) with at least two grinding chambers (20*a*, 20*b*) and a central outlet (20*c*) and a divider (21), wherein at least some of the grinding material of the coarse grinding circuit is divided in the divider and delivered to the two grinding chambers and the grinding material is discharged from the two grinding chambers together via the central outlet, and wherein the ratio of length to width of each grinding chamber (20*a*, 20*b*) is ≦2.2.

2. Grinding station according to claim 1, characterised in that the two grinding chambers (20*a*, 20*b*) are of identical formation and the divider (21) is set such that the grinding material (6) which is delivered to the divider is delivered to the two grinding chambers in equal portions.

3. Grinding station according to claim 1, characterised in that a classifier (22) is provided in the fine grinding circuit, to which classifier at least all the grinding material (7) from the central outlet of the tube mill is delivered.

4. Grinding station according to claim 1, characterised in that a classifier (22) is provided in the fine grinding circuit, to which classifier at least all the grinding material (7) from the central outlet of the tube mill and at least some of the material (6) coming from the coarse grinding circuit is delivered.

5. Grinding station according to claim 1, characterised in that a classifier (22) is provided in the fine grinding circuit, to which classifier at least all the grinding material (7) from the central outlet of the tube mill and optionally the material (6) coming from the coarse grinding circuit is delivered, wherein the coarse material (8) of the classifier reaches a divider (23) and the fine material (9) is removed.

6. Grinding station according to claim 1, characterised in that the two grinding chambers (20*a*, 20*b*) are equipped with grinding bodies.

7. Grinding station according to claim 1, characterised in that grinding balls with a diameter of ≦25 mm are provided in the grinding chambers (20*a*, 20*b*) of the tube mill (20).

* * * * *